US006032928A

United States Patent [19]

Okamoto et al.

[11] Patent Number: 6,032,928

[45] Date of Patent: Mar. 7, 2000

[54] HAND OPERATED CHAIN BLOCK HAVING IMPROVED HAND WHEEL

[75] Inventors: Yosiaki Okamoto; Takasi Uesugi; Eikiti Kobayasi, all of Osaka, Japan

[73] Assignee: Elephant Chain Block Co., Ltd., Osaka, Japan

[21] Appl. No.: 09/071,544

[22] Filed: May 4, 1998

[30] Foreign Application Priority Data

May 15, 1997 [JP] Japan ..... 9-125184

[51] Int. Cl.[7] ..... B66D 1/30

[52] U.S. Cl. ..... 254/372

[58] Field of Search ..... 254/352, 365, 254/371, 372, 373

[56] References Cited

U.S. PATENT DOCUMENTS 2,403,462 7/1946 Schroeder ..... 254/372 X 4,301,979 11/1981 Cavanagh ..... 254/371 X

*Primary Examiner*—Donald P. Walsh

*Assistant Examiner*—Emmanuel M. Marcelo

*Attorney, Agent, or Firm*—Dickstein Shapiro Morin & Oshinsky LLP

[57] ABSTRACT

To provide a hand operated chain block capable of being downsized while enabling a hand chain to be easily wound over a hand wheel without disassembling the hand wheel from a chain block body when the hand chain is seated in the hand wheel, a hooking groove for the hand chain to be hooked is formed in an outer plate of the hand wheel having an inner plate and the outer plate between which the hand chain is fitted. For winding the hand chain over the hand wheel, it is only necessary that after the hand chain is hooked by the hooking groove, the hand wheel is turned.

3 Claims, 7 Drawing Sheets

HAND OPERATED CHAIN BLOCK HAVING IMPROVED HAND WHEEL

BACKGROUND OF THE INVENTION

1. Field of the Invention

The present invention relates to a hand operated chain block and, more particularly, to a hand operated chain block wherein a load sheave is rotationally driven by pulling a hand chain passing over a hand wheel, so as to wind up and down a load chain passing over the load sheave.

2. Description of the Prior Art

In general, a hand operated chain block of this type has a load sheave supported between a pair of side plates via bearings; and a hand wheel disposed at the outside of one side plate, so as to drive the load sheave through a drive shaft. A load chain with a load suspending hook passes over the load sheave, and a hand chain manually pulled passes over the hand wheel. The hand wheel is rotationally driven by pulling the hand chain to drive the load sheave via the drive shaft, so that the load chain is wound up and down to hoist up and down a load suspended from the hook.

With this conventional type of chain block, assembling the hand chain in the hand wheel requires the steps: that after a wheel cover for covering the hand wheel is removed from a chain block body, the hand wheel is disengaged from the drive shaft; and that after the removal of only the hand wheel from the chain block body, the hand chain is seated in the hand wheel and then the hand wheel is assembled back to the chain block body.

The conventional type chain block requiring the removal of the hand wheel from the chain block body for seating the hand chain in the hand wheel has disadvantage that the removal and assembling work is troublesome and also there is a fear that other components e.g. a mechanical brake may fall off together with the hand wheel, during the removal of the hand wheel from the drive shaft.

On the other hand, an attempt to assemble the hand chain in the hand wheel without removing the hand wheel from the drive shaft causes difficulties in downsizing the apparatus, because, stay bolts connecting the pair of side plates, which are usually projected at a radially outer side of the hand wheel to support the wheel cover, must be spaced apart from the outer periphery of the hand wheel with space required for the work of hooking the hand chain and thus cannot be located in the vicinity of the hand wheel.

SUMMARY OF THE INVENTION

It is the object of the present invention is to provide a hand operated chain block which can be attempted to be downsized while enabling the hand chain to be easily wound over the hand wheel without disassembling the hand wheel from the chain block body when the hand chain is seated in the hand wheel.

According to the present invention, a hand operated chain block comprising: a load sheave supported between a pair of side plates via bearing means; a hand wheel, located at an outside of one side plate, for driving the load sheave via a drive shaft, the hand wheel having an inner plate and an outer plate between which a hand chain is able to fit in; and a hooking groove, formed in the outer plate of the hand wheel, for allowing the hand chain to be hooked.

With this construction, for seating the hand chain in the hand wheel, it is only necessary that after the hand chain is hooked by the hooking groove formed in the outer plate of the hand wheel, the hand wheel is turned with hand. Thus, without the need for taking the conventional troublesome step that after the hand wheel is disassembled from the chain block body, the hand chain is seated in the hand wheel, the hand chain can be easily wound over the hand wheel. In addition, even when the stay bolts connecting the pair of side plates are projected at the radially outer side of the hand wheel, since the hand chain can be hooked into the hand wheel from the hooking groove, there is no need to provide specific space for the work of hooking the hand chain between the stay bolts and the periphery of the hand wheel. Thus, the stay bolts can be located in the vicinity of the hand wheel, and as such can allow the apparatus to reduce in size.

According to this invention, it is preferable that the hand wheel is provided with a detachable cover member capable of covering an opening portion of the hooking groove. If the chain block is tilted such that the hand chain comes near to a lower portion of the outer plate of the hand wheel, there is a fear that the hand chain may be engaged into the hooking groove from the opening portion during the winding up operation of the chain block, for example. Because of this, after completion of the seating of the hand chain in the hand wheel, the cover member is fitted to the opening portion of the hooking groove to close it, so as to prevent the hand chain from being engaged into the hooking groove and thereby ensure a smooth hoisting operation.

According to this invention, it is preferable that the cover member has an extended portion capable of covering a marginal portion around the outer plate. When the hand wheel is rotationally driven by pulling the hand chain, the marginal portion around the outer plate of the hand wheel may sometimes contact with the hand chain and the wheel cover covering the hand wheel, to cause noises. The extended portion covering the marginal portion around the hand wheel enables the direct contact between the marginal portion around the outer plate and the hand chain to be prevented, so as to prevent noises and ensure the smooth pulling operation of the hand chain.

BRIEF DESCRIPTION OF THE DRAWINGS

The present invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiments.

Figure 1:
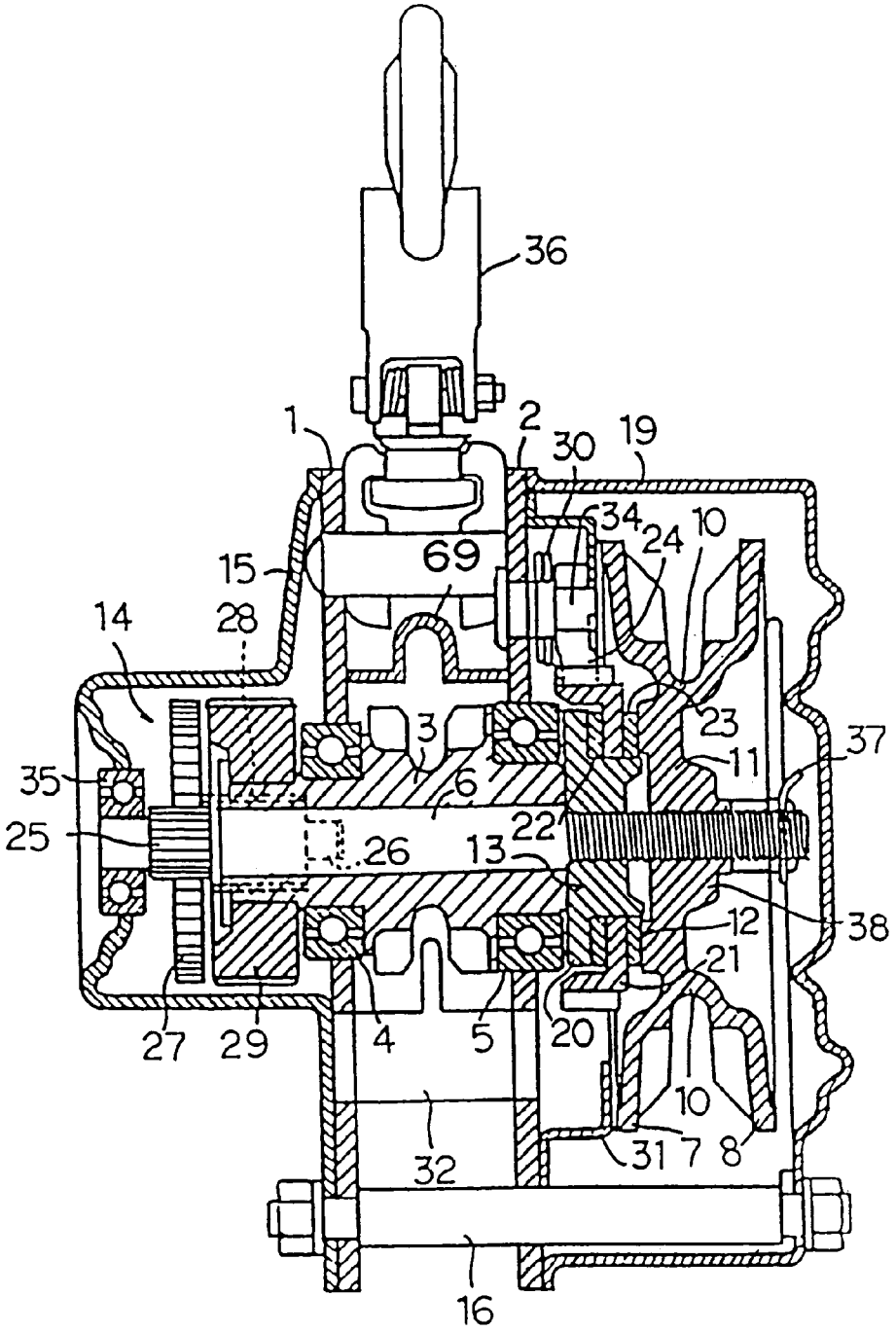
FIG. 1 is a vertical section of the hand operated chain block of an embodied form of the present invention.

FIG. 1 is a vertical section of the hand operated chain block of an embodied form of the present invention. In this hand operated chain block, a load sheave 3, over which a load chain (not shown) passes, is rotatably supported between a pair of spaced apart, opposing, left and right side plates 1, 2 via a pair of bearings 4, 5, and a drive shaft 6 is so inserted in a shaft bore of the load sheave 3 as to be rotatable relative to the load sheave. A hand wheel 11 over which a hand chain 9 (not shown in FIG. 1, but shown in FIGS. 4 and 5 only) is wound is threadedly engaged with the drive shaft 6 at one axial end thereof at the outer side of the right side plate 2. A set pin 37 is inserted in the axial end portion of the drive shaft 6. A transmission mechanism 13 including a mechanical brake 12 is provided between the hand wheel 11 and the load sheave 3.

The transmission mechanism 13 comprises: a driven hub 20 which is so connected to the drive shaft 6 as to be non-rotatable relative thereto (connected in a threaded relation thereto in FIG. 1); a reverse rotation stop gear 21 interposed between a flange portion of the driven hub 20 and the hand wheel 11 and rotatably supported by the driven hub 20; and lining plates 22, 23 interposed between the driven hub 20 and the reverse rotation stop gear 21 and between the reverse rotation stop gear 21 and the hand wheel 11, respectively. The right side plate 2 is provided with a pawl shaft 34, to which a reverse rotation stop pawl 24 engageable with the reverse rotation stop gear 21 is swingably fitted. Between the reverse rotation stop gear 24 and the right side plate 2 is interposed a pawl spring 30 biasing the reverse rotation stop pawl 24 toward the reverse rotation stop gear 21. The mechanical brake 12 is composed of the reverse rotation stop pawl 24, the reverse rotation stop gear 21, the driven hub 20, and the lining plates 22, 23.

On the other hand, the drive shaft 6 is supported by a bearing 35 at the other axial end thereof, and a geared reduction mechanism 14 including a plurality of reduction gears is provided between the bearing 35 and load sheave 3 at the outer side of the left side plate 1. The geared reduction mechanism 14 comprises: a first gear 25 formed integrally with an axial end portion of the drive shaft 6; a pair of second gears 27 engaged with the first gear 25 and supported by a pair of intermediate shafts 26; a pair of third gears 28 engaged with the second gears 27 and supported by the pair of intermediate shafts 26 (only each one of the pairs of intermediate shafts 26, second gears 27 and third gears 28 is represented in FIG. 1); and a fourth gear 29 connected to an extension of the load sheave 3 and engaged with the third gears 28.

A gear cover 15 for covering the geared reduction mechanism 14 and a wheel cover 19, opening at one side thereof, for covering the hand wheel 11 are detachably mounted on the outer sides of the left and right side plates 1, 2, respectively, by three stay bolts 16, 17 and 18 connecting the pair of side plates 1, 2 (only one stay bolt 16 is represented in FIG. 1). Interposed between the right side plate 2 and the hand wheel 11 is a brake cover 31 for covering the periphery of the reverse rotation stop gear 21. 32 denotes a chain split; 36 a hanging hook for hanging a chain block; and 69 a chain guide.

When the hand wheel 11 is driven in the normal rotation direction by pulling the hand chain 9, the drive shaft 6 is driven through the transmission mechanism 13. The drive of the drive shaft is transmitted to the load sheave 3 through the geared reduction mechanism 14, to rotationally drive the load sheave 3, so that the load chain, passing over the load sheave 3, of loading side or of load suspending side with a hook at the foremost end, is wound up to hoist up the load. The hoisted load is maintained in suspension through the action of the mechanical brake 12.

When the hoisted load is lowered, the hand wheel 11 is driven in reverse by pulling the hand chain 9. The hand wheel 11 driven in reverse is screwed backwards along the drive shaft, to drive the load sheave 3 in reverse, while the mechanical brake 12 is alternately actuated and deactuated, so as to lower the load gradually.

Figure 2:
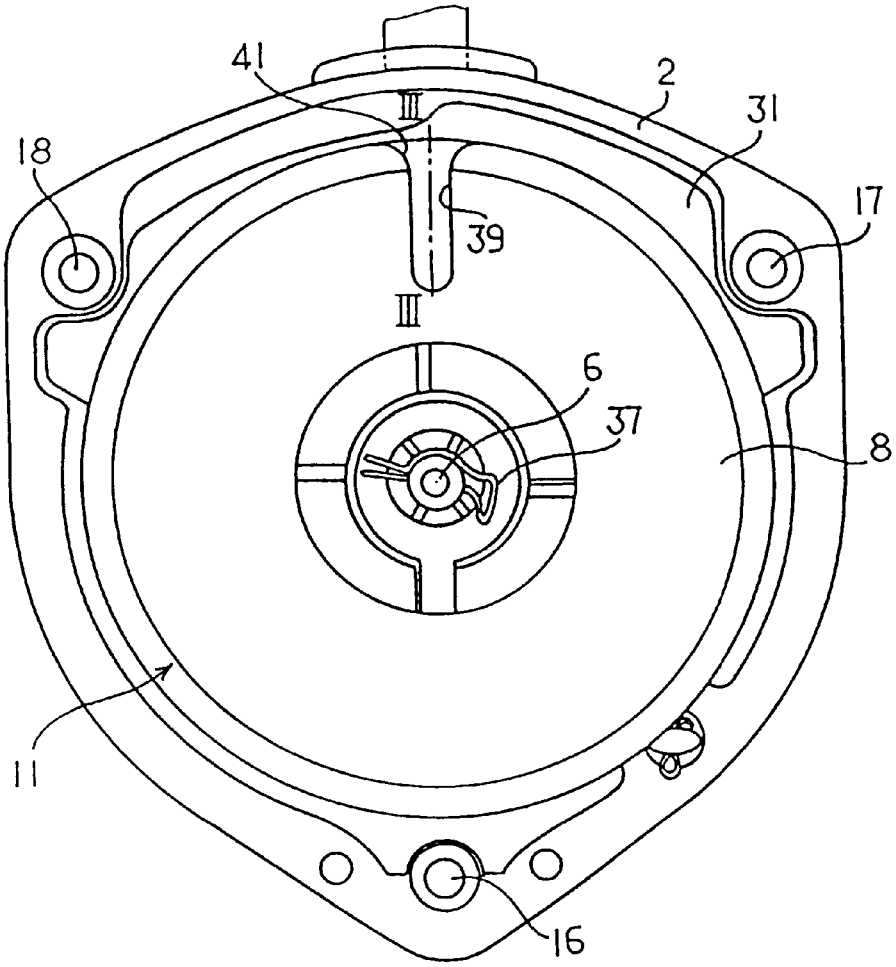
FIG. 2 is a side view, partly omitted, of the hand operated chain block of FIG. 1 from which the wheel cover is removed.
Figure 3:
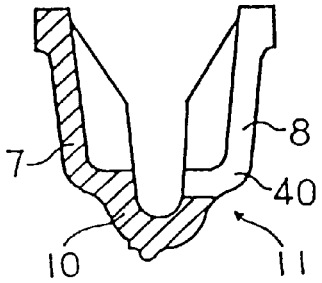
FIG. 3 is a sectional view of the main part taken on line III—III of FIG. 2.

FIG. 2 is a side view, partly omitted, of the hand operated chain block from which the wheel cover 19 is removed; and FIG. 3 is a sectional view of the main part taken on line III—III of FIG. 2. Details of the hand wheel 11 will be described with reference to FIGS. 1, 2 and 3. The hand wheel 11 has, as shown in FIG. 1, a shaft bore portion 38 threadedly engaged with the drive shaft 6; and a generally U-shaped in section chain winding portion 10 formed around the shaft bore portion 38 to be continuous therewith and having an inner plate 7 and an outer plate 8 between which the hand chain 9 is seated in. As shown in FIGS. 2 and 3, the outer plate 8 of the hand wheel 11 is cut out radially inwardly from a marginal portion around the outer plate 8, to form a hooking groove 39 for hooking the hand chain 9. The hooking groove 39 has a width slightly larger than a diameter of the hand chain 9 in order to surely hook the hand chain 9, as shown in FIG. 2, and an innermost end at a curved portion 40 curved along the generally U-shaped in section, chain winding portion 10, as shown in FIG. 3. Also, the hooking groove 39 has, at the marginal portion around the outer plate 8, an opening portion 41 having a width slightly larger than the width at an inner end thereof in order to allow the hand chain 9 to easily fit therein.

Figure 4:
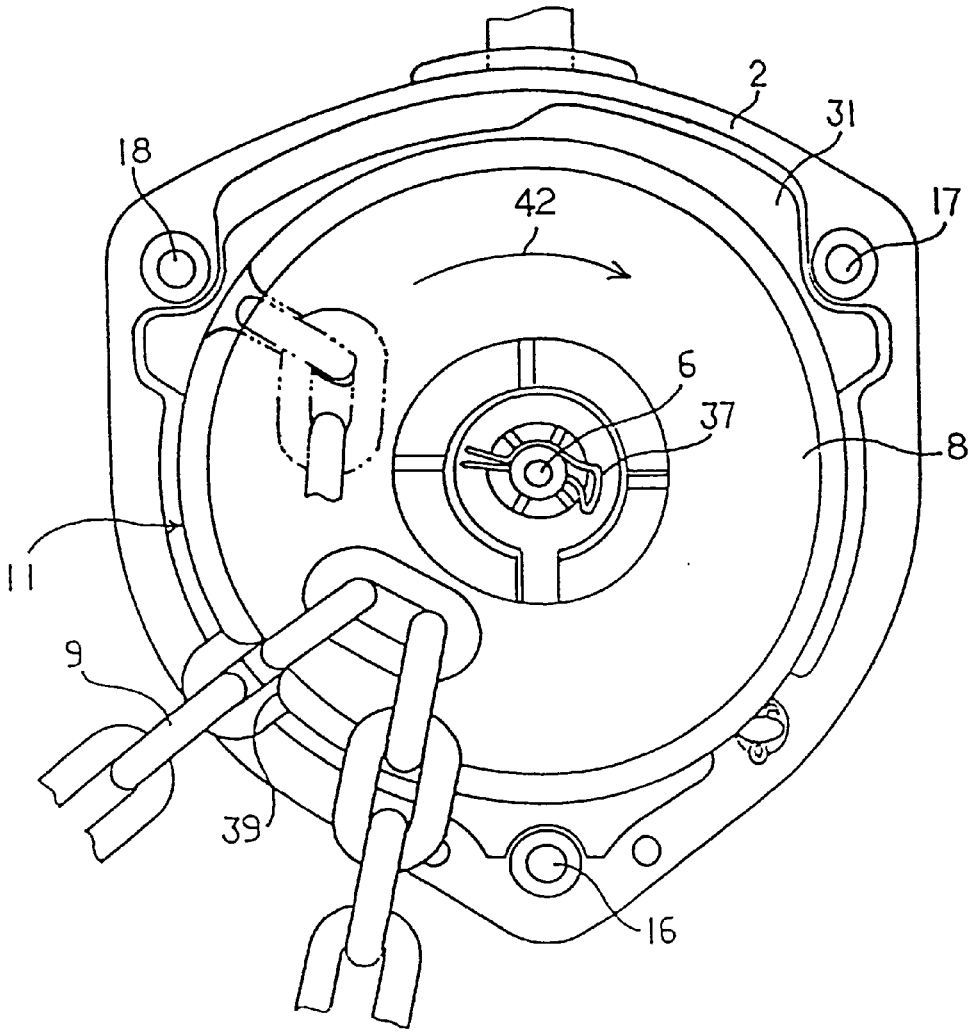
FIG. 4 is an illustration of the operation of winding the hand chain over the hand wheel.
Figure 5:
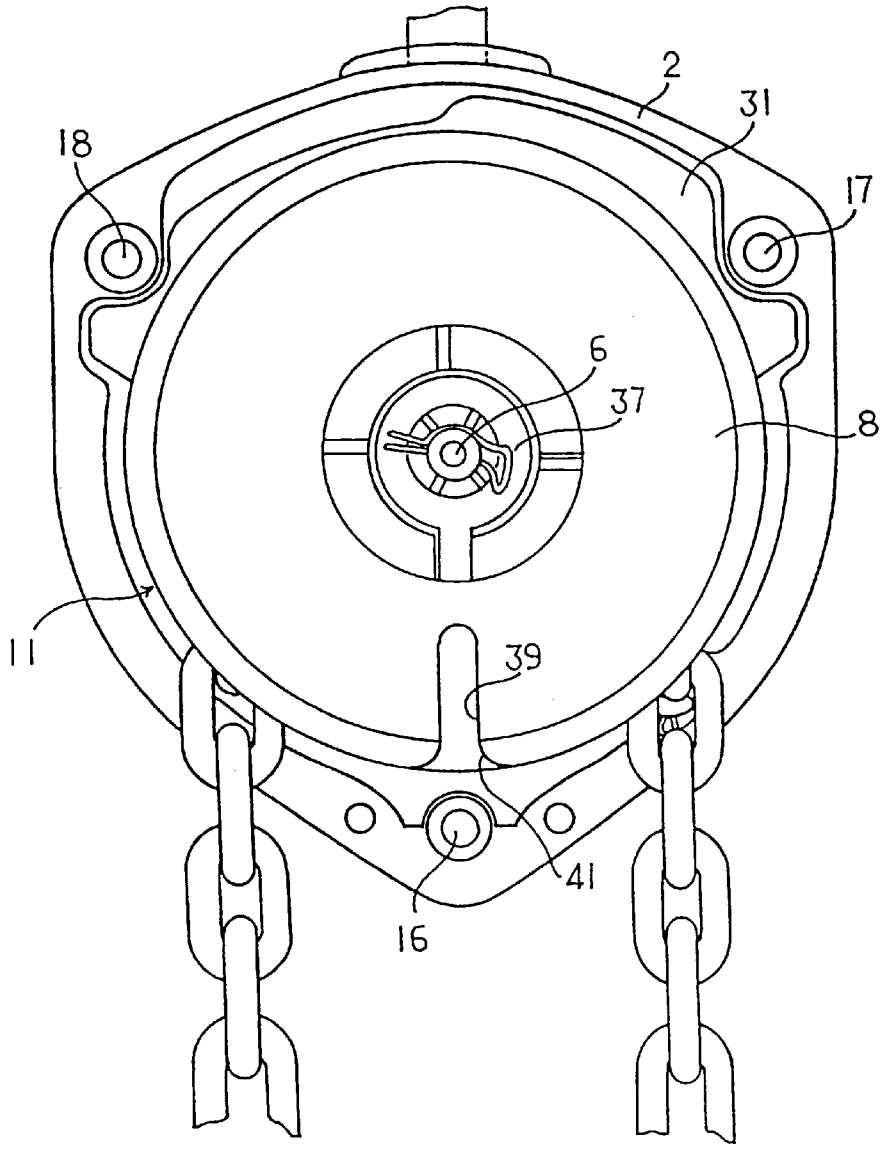
FIG. 5 is an illustration of the operation of winding the hand chain over the hand wheel.

By virtue of the hooking groove 39, it is only necessary for seating the hand chain 9 in the hand wheel 11 that after the hand chain 9 is hooked by the hooking groove 39, as shown in FIG. 4, the hand wheel 11 is turned with hand in the direction indicated by an arrow 42 until the hand chain 9 is properly fit in the hand wheel 11, as shown in FIG. 5. Thus, without the need for taking the conventional troublesome step that after the hand wheel 11 is disengaged from the drive shaft 6 and thus from the chain block body, the hand chain 9 is seated in the hand wheel 11 and then the hand wheel 11 is assembled back to the drive shaft 6, the hand chain 9 can be easily wound over the hand wheel 11 without taking the hand wheel 11 out of the chain block body. On the other hand, to disengage the hand chain 9 from the hand wheel 11, the above-said step may be simply reversed. In other words, after the hand chain 9 is hooked by the hooking groove 39, the hand wheel 11 is turned with hand in the direction opposite to the direction indicated by the arrow 42. This enables the easy removal of the hand chain without removing the hand wheel 11 from the chain block body.

In addition, although the stay bolts 16, 17, 18 connecting the pair of side plates 1, 2, are projected at the radially outer side of the hand wheel 11 to mount thereon the wheel cover 19, since the hand chain 9 can be hooked into the hand wheel 11 from the hooking groove 39 and also is received in the hooking groove 39 without projecting from the periphery of the hand wheel 11, the hand chain 9 does not interfere with the stay bolt 18 even when the stay bolt 18 is arranged close to the periphery of the hand wheel 11, as indicated by a phantom line in FIG. 4. Hence, there is no need to provide specific space for the work of hooking the hand chain 9 between the stay bolts 16, 17, 18 and the periphery of the hand wheel 11. Thus, the stay bolts 16, 17, 18 can be located in the vicinity of the hand wheel 11, and as such can allow the apparatus to reduce in size. It is noted that the hand chain 9 may be hooked into the hand wheel from the rotation direction opposite to that indicated by the arrow 42 in FIG. 4.

Figure 6:
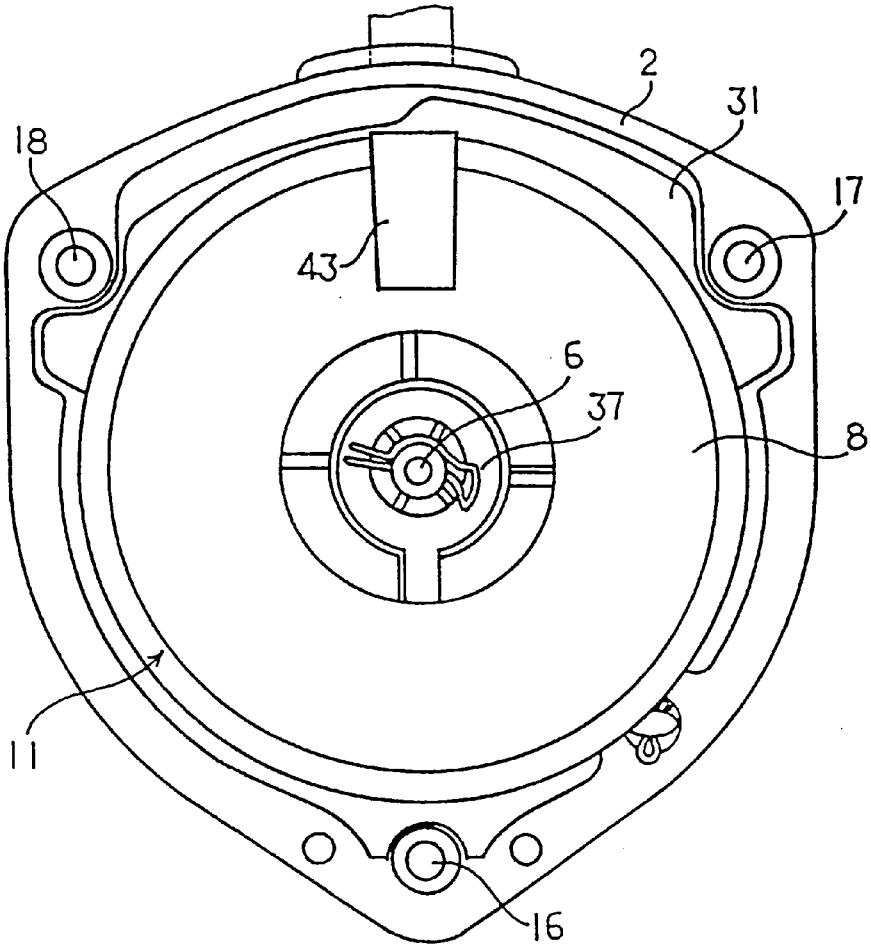
FIG. 6 is a view corresponding to FIG. 2, showing the state of the cover member being attached.
Figure 7:
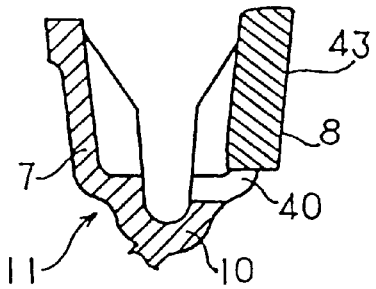
FIG. 7 is a view corresponding to FIG. 3, showing the state of the cover member being attached.

FIGS. 6 and 7 are views corresponding to FIGS. 2 and 3, showing the state of a detachable cover member 43 for covering the opening portion 41 of the hooking groove 39 being fitted into the hooking groove 39. The cover member 43 is formed of elastic material such as rubber and has a U-like shaped section. The cover member 43 has a width slightly larger than the width of the hooking groove 39 and is so formed as to cover the part of the hooking groove extending from the opening portion 41 before the curved portion 40. The cover member 43 is held by its engagement with a marginal portion around the hooking groove 39 of the outer plate 8. Before the hand chain 9 is wound over the hand wheel 11, as mentioned above, the cover member 43 is removed from the hand wheel 11, and after the winding, the cover member 43 is fitted thereto.

When the hoisting operation of the chain block is done by pulling the hand chain 9, if the chain block is tilted with respect to a vertical direction along which the hand chain 9 hangs and accordingly the hand chain 9 is in a likely condition of contacting with a lower portion of the outer plate 8 of the hand wheel 11, there is a fear that the hand chain 9 being wound up over the hand wheel 11 by the winding up operation may be engaged into the hooking groove 39 from the opening portion 41. For this reason, the cover member 43 is fitted to the opening portion 41 of the hooking groove 39 to close it, so as to prevent the hand chain 9 from being engaged into the hooking groove 39 during the winding up operation and thereby ensure a smooth pulling operation of the hand chain 9.

Figure 8:
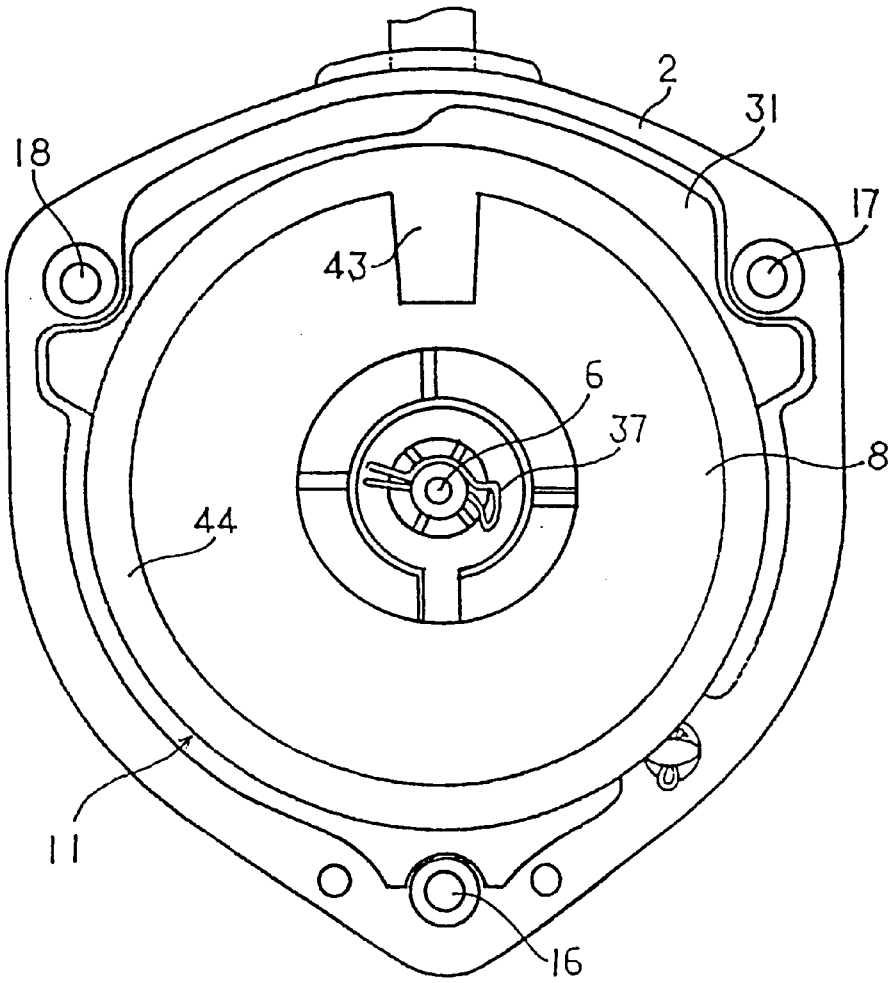
FIG. 8 is a view corresponding to FIG. 6, showing the cover member provided with an extended portion.

FIG. 8 is a view corresponding to FIG. 6, showing a state of the cover member 43 having an extended portion 44 for covering the entirety of the marginal portion around the outer plate 8 being fitted to the hand wheel 11. Like the body of the cover member 43 (the part covering the opening portion 41 of the hanging groove 39), the extended portion 44 has a U-like shape in section. In addition, the extended portion 44 has a ring-like contour extending along the periphery of the hand wheel 11 and is so formed as to be fixedly held by its engagement with the marginal portion around the outer plate 8.

When the hand wheel 11 is rotationally driven by pulling the hand chain 9, the marginal portion around the outer plate 8 of the hand wheel 11 may sometimes contact with the hand chain 9 and the wheel cover 19, to cause noises. The extended portion 44 covering the entirety of the marginal portion around the hand wheel 11 enables the marginal portion around the outer plate 8 of the hand wheel 11 and the hand chain 9 to be prevented from directly contacting with each other, to prevent noises and ensure the smooth pulling operation of the hand chain 9.

Figure 9:
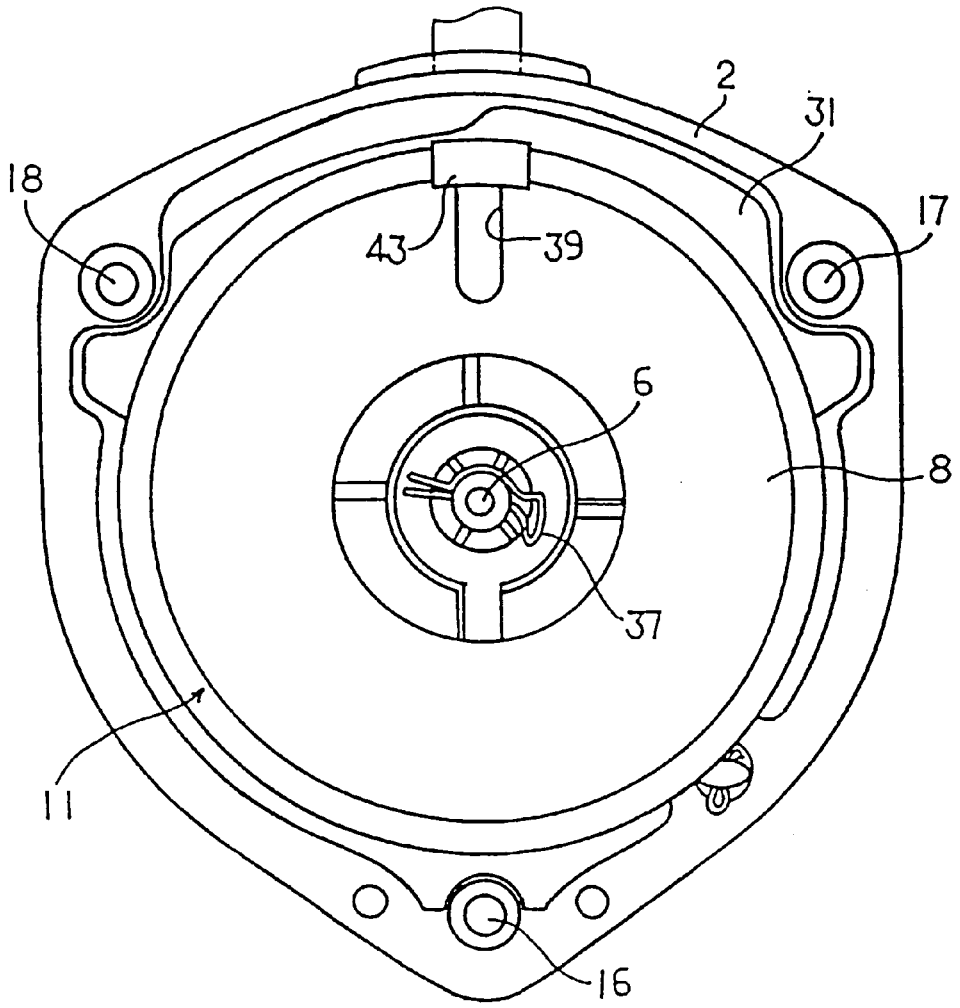
FIG. 9 is a showing of another embodied form corresponding to FIG. 6.
Figure 10:
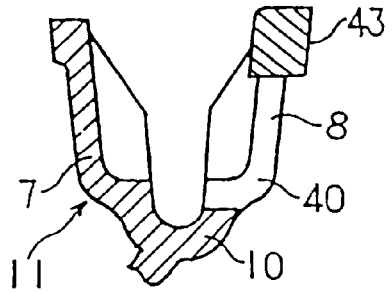
FIG. 10 is a showing of another embodied form corresponding to FIG. 7.

FIGS. 9 and 10 are views corresponding to FIGS. 6 and 7, respectively, showing another embodiment. The cover member 43 is simply required to close and cover the opening portion 41 of the hooking groove 39 and is not necessarily required to cover the part extending from the opening portion 41 before the curved portion 40, as in the above embodiment shown in FIGS. 6 and 7. The cover member 43 may be so modified as to cover only the marginal portion of the opening portion of the outer plate 8, as shown in FIGS. 9 and 10. The reason why the cover member of FIGS. 6 and 7 is so constructed as to cover the part extending from the opening portion 41 before the curved portion 40 is that the fitting of the cover member 43 to the hand wheel 11 can be ensured to prevent the cover member 43 from being easily disengaged from the hand wheel 11 after the fitting.

Though not shown in the accompanying drawings, at least one hooking groove 39 may be formed at any selected places in the hand wheel 11, without limiting to a single hooking groove formed at a single place. In this case, the cover member 43 is fitted to each hooking groove. In addition, the materials of which the cover member 43 may be made include metals such as aluminum, in addition to elastic material. However, in the case of forming the extended portion 44 especially for preventing noises, a material low in resonance property should preferably be used. Further, the extended part 44 may be adapted to partly cover the marginal portion around the outer plate 8, not entirely cover it.

Also, the illustrated embodiment takes the arrangement in which the hand wheel 11 is directly screwed with the drive shaft 6, but may take a modified arrangement in which a hub is threadedly engages with the drive shaft 6; the hand wheel 11 is rotatably supported on the hub; and an overload prevention mechanism for applying resistance to rotation of the hand wheel 11 is provided between the hub and the hand wheel 11.

What is claimed is:

1. A hand operated chain block comprising:

a load sheave supported between a pair of side plates via bearing means;

a hand wheel, located at an outside of one side plate, for driving said load sheave via a drive shaft, said hand wheel having an inner plate and an outer plate between which a hand chain is able to fit; and a hooking groove, formed in said outer plate of said hand wheel, for allowing said hand chain to be hooked so that said hand chain is wound over said hand wheel, said hooking groove forming a cutout on said outer plate extending radially inwardly from a marginal portion of said outer plate.

2. A hand operated chain block according to claim 1, wherein said hand wheel is provided with a detachable cover member for covering an opening portion of said hooking groove.

3. A hand operated chain block according to claim 2, wherein said cover member has an extended portion for covering a marginal portion around said outer plate.

* * * * *